US010407784B2

(12) United States Patent
Calderara et al.

(10) Patent No.: US 10,407,784 B2
(45) Date of Patent: Sep. 10, 2019

(54) ELECTRODE FOR ELECTROLYTIC PROCESSES

(71) Applicant: INDUSTRIE DE NORA S.P.A., Milan (IT)

(72) Inventors: Alice Calderara, Milan (IT); Fabio Timpano, Milan (IT); Takashi Furusawa, Kanagawa (JP)

(73) Assignee: INDUSTRIE DE NORA S.P.A., Milan (IT)

( * ) Notice: Subject to any disclaimer, the term of this patent is extended or adjusted under 35 U.S.C. 154(b) by 91 days.

(21) Appl. No.: 15/572,265

(22) PCT Filed: Jun. 22, 2016

(86) PCT No.: PCT/EP2016/064404

§ 371 (c)(1),
(2) Date: Nov. 7, 2017

(87) PCT Pub. No.: WO2016/207209

PCT Pub. Date: Dec. 29, 2016

(65) Prior Publication Data

US 2018/0127887 A1 May 10, 2018

(30) Foreign Application Priority Data

Jun. 23, 2015 (IT) ..... 102015000026567

(51) Int. Cl.

| | |
|---|---|
| ***C25C 7/00*** | (2006.01) |
| ***C25B 1/00*** | (2006.01) |
| ***C25B 9/00*** | (2006.01) |
| ***C25B 9/16*** | (2006.01) |
| ***C25B 11/04*** | (2006.01) |
| ***C25C 7/02*** | (2006.01) |
| ***C25B 1/02*** | (2006.01) |
| ***C25C 1/12*** | (2006.01) |

(52) U.S. Cl.

CPC ..... *C25B 11/0484* (2013.01); *C25B 1/02* (2013.01); *C25B 11/0405* (2013.01); *C25B 11/0415* (2013.01); *C25C 1/12* (2013.01); *C25C 7/02* (2013.01)

(58) Field of Classification Search

CPC .... C25C 7/02; C25C 7/00; C25B 1/00; C25B 11/0478; C25B 11/0484; C25B 9/00; C25B 9/16

USPC ..... 205/576

See application file for complete search history.

(56) References Cited

U.S. PATENT DOCUMENTS

| | | | | |
|---|---|---|---|---|
| 3,875,043 | A | 4/1975 | Franks | |
| 2006/0153982 | A1* | 7/2006 | Morozov | C01G 19/08 427/226 |
| 2008/0116064 | A1 | 5/2008 | Hashimoto et al. | |
| 2011/0209992 | A1* | 9/2011 | Urgeghe | C25B 1/46 204/263 |

FOREIGN PATENT DOCUMENTS

| | | | |
|---|---|---|---|
| EP | 0004387 | A1 | 10/1979 |
| JP | 2006322056 | A | 11/2006 |

OTHER PUBLICATIONS

International Search Report for International Application No. PCT/EP2016/064404 (dated Aug. 25, 2016) (8 Pages).

International Preliminary Report on Patentability for International Application No. PCT/EP2016/064404 (dated Jun. 14, 2017) (12 Pages).

* cited by examiner

*Primary Examiner* — Zulmariam Mendez

(74) *Attorney, Agent, or Firm* — Lucas & Mercanti, LLP

(57) ABSTRACT

An electrode on valve metal substrate suitable for the evolution of oxygen in electrolytic processes is provided with a coating having a catalytic layer containing platinum group metals and one or more protective layers based on tin oxide modified with a doping element selected from bismuth, antimony or tantalum and with a small amount of ruthenium. The electrode is useful in processes of non-ferrous metal electrowinning.

9 Claims, No Drawings

ELECTRODE FOR ELECTROLYTIC PROCESSES

This application is a U.S. national stage of PCT/EP2016/064404 filed on Jun. 22, 2016 which claims the benefit of priority from Italian Patent Application No. 102015000026567 filed Jun. 23, 2015 the contents of each of which are incorporated herein by reference.

FIELD OF THE INVENTION

The invention relates to an electrode for electrochemical applications, in particular to an electrode for oxygen evolution in metal electrowinning processes.

BACKGROUND OF THE INVENTION

The invention relates to an electrode for electrolytic processes, in particular to an anode suitable for oxygen evolution in an industrial electrolysis process. Anodes for oxygen evolution are widely used in different electrolytic applications, many of which relating to the field of cathodic electrodeposition of metals (electrometallurgy), working in a wide range of applied current density, from very low (a few hundred $A/m^2$, such as in metal electrowinning processes) to extremely high (as in some galvanic electroplating applications, which can operate in excess of 10 $kA/m^2$, with reference to the anodic surface); another field of application of anodes for oxygen evolution is cathodic protection by impressed current. In the field of electrometallurgy, with particular reference to metal electrowinning, lead-based anodes are traditionally used, still valid for certain applications although presenting a rather high oxygen evolution overpotential and also entailing well-known risks for the environment and human health. More recently, electrodes for anodic oxygen evolution obtained from substrates of valve metals, for example titanium and its alloys, coated with catalyst compositions based on metals or oxides thereof were introduced in the market, especially for high current density applications, which benefit the most of the energy savings associated with a decreased oxygen evolution potential. A typical composition suitable to catalyse the anodic oxygen evolution reaction consists for instance of a mixture of oxides of iridium and tantalum, wherein iridium is the catalytically active species and tantalum facilitates the formation of a compact coating, capable of protecting the valve metal substrate from corrosion, particularly for operation in aggressive electrolytes. Another very effective formulation for catalysing the anodic oxygen evolution reaction consists of a mixture of oxides of iridium and tin, with small quantities of doping elements such as bismuth, antimony, tantalum or niobium, useful to make the tin oxide phase more conductive.

An electrode with the above composition is capable of satisfying the needs of many industrial applications, both at low and at high current density, with sufficiently reduced operating voltages and reasonable durations. The economy of certain manufacturing processes especially in the domain of metallurgy (such as copper or tin electrowinning) nevertheless requires electrodes of even higher duration than the above compositions. To achieve this goal, protective intermediate layers are known based on valve metal oxides, for example mixtures of tantalum and titanium oxides, capable of further preventing the corrosion of the valve metal substrate. The intermediate layers thus formulated are nevertheless characterised by a rather low electric conductivity and can only be used at a very reduced thickness, not exceeding 0.5 μm, so that the resulting increase in the operating voltage is contained within acceptable limits. In other words, a compromise must be found between a suitable operational lifetime, favoured by a higher thickness, and a reduced overpotential, favoured by a lower one.

Another problem observed with the above described catalytic formulations is the tendency of iridium-containing catalytic coatings to leach a sensible amount of iridium into the electrolyte during the start-up phase and the first hours of operation. This seems to suggests that a fraction of the iridium oxide of the coating, although electrochemically active, is present in a phase less resistant to corrosion by the electrolyte. This phenomenon, which to a certain extent takes place also with other noble metal catalysts such as ruthenium, can be mitigated by overlaying porous protective layers to the catalytic coating, for example based on tantalum or tin oxide. Such external protective layers, however, have a limited effectiveness and cause an increase in the operating voltage of the electrode.

It has thus been evidenced the need to provide anodes for oxygen evolution characterised by an enhanced operational duration and by a reduced release of noble metals in the first hours of operation, while presenting a very high catalytic activity towards the oxygen evolution reaction.

SUMMARY OF THE INVENTION

Various aspects of the invention are set out in the accompanying claims.

Under one aspect, the invention relates to an electrode suitable for oxygen evolution in electrolytic processes comprising a valve metal substrate—for example made of titanium or titanium alloy—equipped with a coating comprising at least one protective layer consisting of a mixture of oxides with a composition by weight referred to the metals comprising 89-97% tin, 2-10% total of one or more doping elements selected from bismuth, antimony and tantalum and 1-9% ruthenium. The experiments carried out by the inventors showed that bismuth provides the best results compared to other doping elements, but the invention can be successfully practised also with antimony and tantalum. The protective layer as described has no appreciable catalytic activity, being instead suitable for being combined with a catalytic layer containing noble metal oxides, the latter constituting the active component deputed to decrease the overpotential of the oxygen evolution reaction. In one embodiment, the coating may comprise a protective layer interposed between the substrate and the catalytic layer, especially effective in preventing the corrosion of the substrate. In one embodiment, the coating may comprise a protective layer external to the catalytic layer, especially effective in preventing the release of noble metal from the catalytic layer during the start-up phase or the early hours of operation of the electrode. In a further embodiment, there may be present both a protective layer interposed between the substrate and the catalytic layer and a protective layer external to the catalytic layer. In one embodiment, each of the protective layers of the coating has a thickness of 1 to 5 μm. It could be in fact experimentally verified how the characteristics in terms of electrical conductivity and porosity typical of a protective layer as hereinbefore described allow operating with such a high thickness without detrimental effects on the electrode potential and with substantial benefits in terms of operational lifetime.

In one embodiment, the catalytic layer of the coating has a composition by weight referred to the metals comprising 40-46% of a platinum group metal, 7-13% of one or more doping elements selected from bismuth, tantalum, niobium or antimony and 47-53% tin, with a thickness of 2.5 to 5 μm. It was observed that this formulation of catalytic layer allows exploiting the benefits of the protective layer as hereinbefore described to a greater extent, in particular when the metal of the platinum group is selected between iridium and a mixture of iridium and ruthenium and the selected doping element is bismuth. In one embodiment, the selected platinum group metal is a mixture of iridium and ruthenium in an Ir:Ru weight ratio of 60:40 to 40:60.

Under one aspect, the invention relates to a process of cathodic electrodeposition of metals from an aqueous solution, for instance a copper electrowinning process, wherein the corresponding anodic reaction is an evolution of oxygen carried out on the surface of an electrode as hereinbefore described.

The following examples are included to demonstrate particular embodiments of the invention, whose practicability has been largely verified in the claimed range of values. It should be appreciated by those of skill in the art that the compositions and techniques disclosed in the examples which follow represent compositions and techniques discovered by the inventors to function well in the practice of the invention; however, those of skill in the art should, in light of the present disclosure, appreciate that many changes can be made in the specific embodiments which are disclosed and still obtain a like or similar result without departing from the scope of the invention.

All samples cited in the following examples were manufactured starting from a mesh of titanium grade 1 of 200 mm×200 mm×1 mm size, degreased with acetone in a ultrasonic bath for 10 minutes and subjected first to grit blasting with corundum until obtaining a surface roughness value Rz of 25 to 35 μm, then to annealing for 2 hours at 570° C., and finally to etching in 22% by weight HCl at boiling temperature for 30 minutes, checking that the resulting weight loss was between 180 and 250 g/m$^2$.

All the layers of the coating were applied by brush.

EXAMPLE 1

A 1.65 M solution of Sn hydroxyacetochloride complex (SnHAC) was prepared according to the procedure described in WO 2005/014885.

Two distinct 0.9 M solutions of hydroxyacetochloride complexes of Ir and Ru (IrHAC and RuHAC) were prepared according to the procedure described in WO2010055065. A solution containing 50 g/l of bismuth was prepared by dissolving 7.54 g of $BiCl_3$ at room temperature under stirring in a beaker containing 60 ml of 10% by weight HCl, then bringing the volume to 100 ml with 10% by weight HCl upon observing that a transparent solution had been obtained, indicating that the dissolution was completed.

5.11 ml of the 1.65 M SnHAC solution, 0.23 ml of the 9 M RuHAC solution and 0.85 ml of the 50 g/l Bi solution were added into a beaker kept under stirring. The stirring was prolonged for 5 minutes. 18.57 ml of 10% by weight acetic acid were then added.

The solution was applied to a sample of the pretreated titanium mesh by brushing in 6 coats, with a drying step at 60° C. for 10 minutes after each coat and a subsequent thermal decomposition step at 520° C. for 10 minutes.

In this way, an internal protective layer with a Sn:Bi:Ru weight ratio of 94:4:2, a thickness of 4 μm and a specific Sn loading of about 9 g/m$^2$ was obtained.

10.15 ml of the 1.65 M SnHAC solution, 10 ml of the 0.9 M IrHAC solution and 7.44 ml of the 50 g/l Bi solution were added into a second beaker kept under stirring. The stirring was prolonged for 5 minutes. 20 ml of 10% by weight acetic acid were then added.

The solution was applied over the previously obtained internal protective layer by brushing in 13 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9, a thickness of 4.5 μm and a specific loading of Ir of about 10 g/m$^2$ was obtained.

The electrode was labelled "EX1".

COUNTEREXAMPLE 1

A protective layer based on titanium and tantalum oxides in a 80:20 molar ratio, with an overall loading of 1.3-1.6 g/m$^2$ referred to the metals (corresponding to 1.88-2.32 g/m$^2$ referred to the oxides) was applied to a titanium mesh sample. The application of the protective layer was carried out by painting in four coats a precursor solution—obtained by addition of an aqueous solution of $TaCl_5$, acidified with HCl, to an aqueous solution of $TiCl_4$—with subsequent thermal decomposition at 515° C. 10.15 ml of the 1.65 M SnHAC solution, 10 ml of the 0.9 M IrHAC solution and 7.44 ml of the 50 g/l Bi solution were added into a beaker kept under stirring. The stirring was prolonged for 5 minutes. 20 ml of 10% by weight acetic acid were then added.

The solution was applied over the previously obtained protective layer by brushing in 14 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9, a thickness of 4.5 μm and a specific loading of Ir of about 10 g/m$^2$ was obtained.

The electrode was labelled "CE1".

COUNTEREXAMPLE 2

A protective layer based on titanium and tantalum oxides in a 80:20 molar ratio, with an overall loading of 7 g/m$^2$ referred to the metals (10.15 g/m$^2$ referred to the oxides) was applied to a titanium mesh sample. The application of the protective layer was carried out by painting in four coats a precursor solution—obtained by addition of an aqueous solution of $TaCl_5$, acidified with HCl, to an aqueous solution of $TiCl_4$—with subsequent thermal decomposition at 515° C. 10.15 ml of the 1.65 M SnHAC solution, 10 ml of the 0.9 M IrHAC solution and 7.44 ml of the 50 g/l Bi solution were added into a beaker kept under stirring. The stirring was prolonged for 5 minutes. 20 ml of 10% by weight acetic acid were then added.

The solution was applied over the previously obtained protective layer by brushing in 14 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9, a thickness of 4.5 μm and a specific loading of Ir of about 10 g/m$^2$ was obtained.

The electrode was labelled "CE2".

EXAMPLE 2

Some coupons of 20 mm×50 mm area were cut-out from the electrodes of the above example and counterexamples to be subjected to the detection of their anodic potential under oxygen evolution—measured with a Luggin capillary and a platinum probe as known in the art—in a 150 g/l $H_2SO_4$ aqueous solution at 50° C. The data reported in Table 1 (CISEP) represent the values of potential detected at the current density of 500 A/m$^2$. Table 1 also shows the lifetime displayed in an accelerated life test (ALT) in a 150 g/l $H_2SO_4$ aqueous solution, at a current density of 30 kA/m$^2$ and a temperature of 60° C.

The results of these tests show how providing an internal protective layer according to the invention allows obtaining a significant increase in the duration accompanied by an improvement of the oxygen evolution potential compared to internal protective layers according to the prior art consisting of a mixture of titanium and tantalum oxides.

Similar results were obtained by varying the nature of the doping element and the concentrations of the constituents of the protective layer as set out in the appended claims.

TABLE 1

| sample # | CISEP/V (500 A/m$^2$ in $H_2SO_4$ 150 g/l, 50° C.) | ALT/h (30 kA/m$^2$ in $H_2SO_4$ 150 g/l, 60° C.) |
|---|---|---|
| EX1 | 1.522 | 1385 |
| CE1 | 1.534 | 900 |
| CE2 | 1.583 | 960 |

EXAMPLE 3

5.11 ml of the 1.65 M SnHAC solution, 0.23 ml of the 9 M RuHAC solution and 0.85 ml of the 50 g/l Bi solution were added into a beaker kept under stirring. The stirring was prolonged for 5 minutes. 18.57 ml of 10% by weight acetic acid were then added. The solution was applied to a sample of the pretreated titanium mesh by brushing in 6 coats, with a drying step at 60° C. for 10 minutes after each coat and a subsequent thermal decomposition step at 520° C. for 10 minutes.

In this way, an internal protective layer with a Sn:Bi:Ru weight ratio of 94:4:2, a thickness of 4 μm and a specific Sn loading of about 9 g/m$^2$ was obtained.

10.15 ml of the 1.65 M SnHAC solution, 10 ml of the 0.9 M IrHAC solution and 7.44 ml of the 50 g/l Bi solution were added into a second beaker kept under stirring. The stirring was prolonged for 5 minutes. 20 ml of 10% by weight acetic acid were then added.

The solution was applied over the previously obtained internal protective layer by brushing in 13 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9, a thickness of 4.5 μm and a specific loading of Ir of about 10 g/m$^2$ was obtained.

5.11 ml of the 1.65 M SnHAC solution, 0.23 ml of the 9 M RuHAC solution and 0.85 ml of the 50 g/l Bi solution were added into a third beaker kept under stirring. The stirring was prolonged for 5 minutes. 18.57 ml of 10% by weight acetic acid were then added.

The solution was applied over the previously obtained layers by brushing in 4 coats, with a drying step at 60° C. for 10 minutes after each coat and a subsequent thermal decomposition step at 520° C. for 10 minutes.

In this way, an external protective layer with a Sn:Bi:Ru weight ratio of 94:4:2, a thickness of 3 μm and a specific loading of Sn of about 6 g/m$^2$ was obtained.

The electrode was labelled "EX3".

EXAMPLE 4

5.11 ml of the 1.65 M SnHAC solution, 0.23 ml of the 9 M RuHAC solution and 0.85 ml of the 50 g/l Bi solution were added into a beaker kept under stirring. The stirring was prolonged for 5 minutes. 18.57 ml of 10% by weight acetic acid were then added.

The solution was applied to a sample of the pretreated titanium mesh by brushing in 6 coats, with a drying step at 60° C. for 10 minutes after each coat and a subsequent thermal decomposition step at 520° C. for 10 minutes.

In this way, an internal protective layer with a Sn:Bi:Ru weight ratio of 94:4:2, a thickness of 4 μm and a specific Sn loading of about 9 g/m$^2$ was obtained.

10.15 ml of the 1.65 M SnHAC solution, 10 ml of the 0.9 M IrHAC solution and 7.44 ml of the 50 g/l Bi solution were added into a second beaker kept under stirring. The stirring was prolonged for 5 minutes. 20 ml of 10% by weight acetic acid were then added.

The solution was applied over the previously obtained internal protective layer by brushing in 13 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9 and a specific loading of Ir of about 10 g/m$^2$ was obtained.

5 ml of the 1.65 M SnHAC solution and 15 ml of 10% by weight acetic acid were then added into a third beaker kept under stirring.

The solution was applied over the previously obtained layers by brushing in 6 coats, with a drying step at 60° C. for 10 minutes after each coat and a subsequent thermal decomposition step at 520° C. for 10 minutes.

In this way, an external protective layer with a specific loading of Sn of about 9 g/m$^2$ was obtained.

The electrode was labelled "EX4".

EXAMPLE 5

A protective layer based on titanium and tantalum oxides in a 80:20 molar ratio, with an overall loading of 1.3-1.6 g/m$^2$ referred to the metals (corresponding to 1.88-2.32 g/m$^2$ referred to the oxides) was applied to a titanium mesh sample. The application of the protective layer was carried out by painting in four coats a precursor solution—obtained by addition of an aqueous solution of $TaCl_5$, acidified with HCl, to an aqueous solution of $TiCl_4$—with subsequent thermal decomposition at 515° C. 10.15 ml of the 1.65 M SnHAC solution, 10 ml of the 0.9 M IrHAC solution and 7.44 ml of the 50 g/l Bi solution were added into a beaker kept under stirring. The stirring was prolonged for 5 minutes. 20 ml of 10% by weight acetic acid were then added.

The solution was applied over the previously obtained protective layer by brushing in 14 coats, with a drying step at 60° C. for 10 minutes after each coat and a subsequent thermal decomposition step at 520° C. for 10 minutes.

In this way, a catalytic layer with an Ir:Sn:Bi weight ratio of 42:49:9 and a specific loading of Ir of about 10 g/m$^2$ was obtained.

5.11 ml of the 1.65 M SnHAC solution, 0.23 ml of the 9 M RuHAC solution and 0.85 ml of the 50 g/l Bi solution were added into a second beaker kept under stirring. The stirring was prolonged for 5 minutes. 18.57 ml of 10% by weight acetic acid were then added.

The solution was applied to the previously obtained catalytic layer by brushing in 6 coats, with a drying step at 60° C. for 10 minutes after each coat and a subsequent thermal decomposition step at 520° C. for 10 minutes.

In this way, an external protective layer with a Sn:Bi:Ru weight ratio of 94:4:2, a thickness of 4 μm and a specific Sn loading of about 9 g/m$^2$ was obtained.

The electrode was labelled "EX5".

EXAMPLE 6

5.11 ml of the 1.65 M SnHAC solution, 0.23 ml of the 9 M RuHAC solution and 0.85 ml of the 50 g/l Bi solution were added into a beaker kept under stirring. The stirring was prolonged for 5 minutes. 18.57 ml of 10% by weight acetic acid were then added.

The solution was applied to a sample of the pretreated titanium mesh by brushing in 6 coats, with a drying step at 60° C. for 10 minutes after each coat and a subsequent thermal decomposition step at 520° C. for 10 minutes.

In this way, an internal protective layer with a Sn:Bi:Ru weight ratio of 94:4:2, a thickness of 4 μm and a specific Sn loading of about 9 g/m$^2$ was obtained.

5.15 ml of the 1.65 M SnHAC solution, 2.5 ml of the 0.9 M IrHAC solution, 4.75 ml of the 0.9 M RuHAC solution and 3.71 ml of the 50 g/l Bi solution were added into a second beaker kept under stirring. The stirring was prolonged for 5 minutes. 21.7 ml of 10% by weight acetic acid were then added.

The solution was applied over the previously obtained internal protective layer by brushing in 9 coats, with a drying step at 60° C. for 10 minutes after each coat and a subsequent thermal decomposition step at 520° C. for 10 minutes.

In this way, a catalytic layer with an Ir:Ru:Sn:Bi weight ratio of 21:21:49:9, a thickness of 3.5 μm and a specific loading of Ir+Ru of about 7 g/m$^2$ was obtained.

5.11 ml of the 1.65 M SnHAC solution, 0.23 ml of the 9 M RuHAC solution and 0.85 ml of the 50 g/l Bi solution were added into a third beaker kept under stirring. The stirring was prolonged for 5 minutes. 18.57 ml of 10% by weight acetic acid were then added.

The solution was applied to the previously obtained layers by brushing in 4 coats, with a drying step at 60° C. for 10 minutes after each coat and a subsequent thermal decomposition step at 520° C. for 10 minutes.

In this way, an external layer with a Sn:Bi:Ru weight ratio of 94:4:2, a thickness of 3 μm and a specific loading of Sn of about 6 g/m$^2$ was obtained.

The electrode was labelled "EX6".

EXAMPLE 7

Some coupons of 20 mm×50 mm area were cut-out from the electrodes of the above examples to be subjected to the detection of their anodic potential under oxygen evolution—measured with a Luggin capillary and a platinum probe as known in the art—in a 150 g/l $H_2SO_4$ aqueous solution at 50° C. The data reported in Table 2 (CISEP) represent the values of potential detected at the current density of 500 A/m$^2$. Table 2 also shows the lifetime displayed in an accelerated life test (ALT) in a 150 g/l $H_2SO_4$ aqueous solution, at a current density of 30 kA/m$^2$ and a temperature of 60° C.

TABLE 2

| sample # | CISEP/V (500 A/m$^2$ in $H_2SO_4$ 150 g/l, 50° C.) | ALT/h (30 kA/m$^2$ in $H_2SO_4$ 150 g/l, 60° C.) |
|---|---|---|
| EX3 | 1.518 | 1421 |
| EX4 | 1.526 | 1394 |
| EX5 | 1.549 | 996 |
| EX6 | 1.506 | 1424 |

The results show how an external protective layer containing tin oxides allows increasing the operational lifetime of electrodes, at the expense of an increase in their anodic overpotential. However, if the protective external layer containing tin oxides is a protective layer according to the invention, the increase in the operational lifetime is further enhanced, probably due to the stabilisation of iridium at the start-up and during the first hours of operation, while the anodic potential remains low.

Similar results were obtained by varying the nature of the doping element and the concentrations of the constituents of the protective layer as set out in the appended claims.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps. The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

The invention claimed is:

1. Electrode suitable for oxygen evolution in electrolytic processes comprising a valve metal substrate provided with a coating, said coating comprising a catalytic layer and at least one protective layer external to said catalytic layer, said protective layer consisting of a mixture of oxides having a weight composition referred to the metals containing 89-97% of tin, 2-10% of at least one doping element selected from the group consisting of bismuth, antimony and tantalum and 1-9% of ruthenium.

2. The electrode according to claim 1 wherein said at least one protective layer consists of a mixture of oxides having a weight composition referred to the metals containing 89-97% of tin, 2-10% of bismuth and 1-9% of ruthenium.

3. The electrode according to claim 1, wherein said at least one protective layer has a thickness of 1 to 5 μm.

4. The electrode according to claim 1, wherein said a catalytic layer is contact with said protective layer, said catalytic layer comprising a mixture of oxides having a weight composition referred to the metals containing 40-46% of platinum group metals, 7-13% of at least one element selected from the group consisting of bismuth, antimony, niobium and tantalum and 47-53% of tin, said catalytic layer having a thickness of 2.5 to 5 μm.

5. The electrode according to claim 4, wherein said catalytic layer comprises a mixture of oxides having a weight composition referred to the metals containing 40-46% of iridium, 7-13% of bismuth and 47-53% of tin, said catalytic layer having a thickness of 2.5 to 5 μm.

6. The electrode according to claim 4, wherein said catalytic layer consists of a mixture of oxides having a weight composition referred to the metals containing 47-53% of tin, 7-13% of bismuth, 40-46% as the sum of ruthenium and iridium, said catalytic layer having a thickness of 2.5 to 5 μm.

7. The electrode according to claim 6 wherein the weight ratio referred to the metals of iridium to ruthenium in said sum of iridium and ruthenium ranges between 60:40 and 40:60.

8. The electrode according to claim 4 comprising at least two of said protective layers, said catalytic layer being interposed between said at least two protective layers.

9. Process of cathodic electrodeposition of metals from an aqueous solution comprising the anodic evolution of oxygen on the surface of an electrode according to claim 1.

* * * * *